US010808706B2

(12) United States Patent
Watanabe

(10) Patent No.: US 10,808,706 B2
(45) Date of Patent: Oct. 20, 2020

(54) BLOWING DEVICE

(71) Applicant: DENSO CORPORATION, Kariya, Aichi-pref. (JP)

(72) Inventor: Fuminobu Watanabe, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 56 days.

(21) Appl. No.: 16/307,509

(22) PCT Filed: May 18, 2017

(86) PCT No.: PCT/JP2017/018718
§ 371 (c)(1),
(2) Date: Dec. 6, 2018

(87) PCT Pub. No.: WO2017/212893
PCT Pub. Date: Dec. 14, 2017

(65) Prior Publication Data

US 2019/0301470 A1 Oct. 3, 2019

(30) Foreign Application Priority Data

Jun. 9, 2016 (JP) ..... 2016-115434

(51) Int. Cl.
*F04D 29/52* (2006.01)
*F04D 19/00* (2006.01)
(Continued)

(52) U.S. Cl.
CPC ..... *F04D 19/002* (2013.01); *F04D 25/06* (2013.01); *F04D 29/526* (2013.01); *F04D 29/54* (2013.01);
(Continued)

(58) Field of Classification Search
CPC ..... F04D 19/002; F04D 29/54; F04D 29/66; F04D 25/06; F04D 29/526; F04D 29/541; F04D 29/667; F04D 29/547
See application file for complete search history.

(56) References Cited

U.S. PATENT DOCUMENTS 7,789,622 B2 * 9/2010 Acre ..... F04D 29/164 415/209.3
9,829,010 B2 * 11/2017 Yoshida ..... F04D 29/164
(Continued)

FOREIGN PATENT DOCUMENTS

JP H02185700 A 7/1990
JP 2013142374 A 7/2013
(Continued)

*Primary Examiner* — Eldon T Brockman
(74) *Attorney, Agent, or Firm* — Harness, Dickey & Pierce, P.L.C.

(57) ABSTRACT

A blowing device includes: an axial fan; and a fan shroud housing the axial fan. The fan shroud includes an air inlet part into which an air flow is introduced, the air inlet part having a shape corresponding to a peripheral shape of a heat exchanger, and an air outlet part from which the air flow introduced into the air inlet part flows out. The fan shroud further includes a passage formation part to define an air passage through which air introduced from the air inlet part flows to the air outlet part. The passage formation part has at least one rib projected toward the heat exchanger. The rib is defined within a range corresponding to a narrow portion where the air inlet part and a peripheral part of the axial fan are close to each other in a radial direction of the axial fan.

13 Claims, 16 Drawing Sheets

(51) Int. Cl.
*F04D 25/06* (2006.01)
*F04D 29/54* (2006.01)
*F04D 29/66* (2006.01)

(52) U.S. Cl.
CPC ..... *F04D 29/541* (2013.01); *F04D 29/66* (2013.01); *F04D 29/667* (2013.01)

(56) References Cited

U.S. PATENT DOCUMENTS

| | | | | |
|---|---|---|---|---|
| 10,330,354 | B2 * | 6/2019 | Kwon | F25D 23/003 |
| 2014/0334917 | A1 | 11/2014 | Yoshida et al. | |
| 2017/0314827 | A1 * | 11/2017 | Kwon | F25D 23/003 |

FOREIGN PATENT DOCUMENTS

| | | | |
|---|---|---|---|
| JP | 2014181662 | A | 9/2014 |
| JP | 2016089628 | A | 5/2016 |
| WO | WO-2009062292 | A1 | 5/2009 |

* cited by examiner

BLOWING DEVICE

CROSS REFERENCE TO RELATED APPLICATIONS

This application is a U.S. National Phase Application under 35 U.S.C. 371 of International Application No. PCT/JP2017/018718 filed on May 18, 2017. This application is based on and claims the benefit of priority from Japanese Patent Application No. 2016-115434 filed on Jun. 9, 2016. The entire disclosures of all of the above applications are incorporated herein by reference.

TECHNICAL FIELD

The present disclosure relates to a blowing device including a fan shroud arranged to surround an outer side of an axial fan.

BACKGROUND ART

Conventionally, a blowing device is known, which includes an axial fan that generates an air flow to pass a heat exchanger, and a fan shroud that introduces an air flow from the heat exchanger to the axial fan.

The fan shroud of such a kind of blowing device has an air inlet part opposing the heat exchanger, and an air outlet part opposing the axial fan. The air inlet part is shaped in a rectangle corresponding to the outer shape of the heat exchanger. The air outlet part is shaped in a ring form surrounding the outer side of the axial fan. The fan shroud shaped in such has a long portion and a short portion in the radial direction of the axial fan, where a distance between the air inlet part and a peripheral part of the axial fan (hereafter called as a length of an air introducing part) is long or short.

In the short portion of the fan shroud where the length of the air introducing part is short, compared with the long portion where the length of the air introducing part is long, the amount of air which flows into the axial fan from the heat exchanger easily decreases. Moreover, the direction of air flow is not stable in the short portion of the fan shroud where the length of the air introducing part is short, compared with the long portion where the length of the air introducing part is long.

For this reason, since the air flow is disturbed greatly in the short portion where the length of the air introducing part is short, a periodic pressure fluctuation tends to become extremely large near the peripheral side of the axial fan, compared with its circumferential location. Thereby, noise caused by rotation of the axial fan (namely, rotation noise) is easily generated in the short portion of the fan shroud where the length of the air introducing part is short.

Patent Literature 1 discloses a projection end portion projected outward, which is provided at a position defined by advancing in the rotational direction from the short portion where the length of the air introducing part is short in the fan shroud, to increase the flow rate of air in the short portion.

PRIOR ART LITERATURES

Patent Literature

Patent Literature 1: JP 2013-142374 A

SUMMARY OF INVENTION

However, like Patent Literature 1, in case where the projection end portion projected outward is provided to a fan shroud, the outer shape of the fan shroud becomes large and it becomes difficult to mount the blowing device.

It is an object of the present disclosure to provide a blowing device in which the rotation noise is reduced while the blower device is easily mounted.

According to an aspect of the present disclosure, a blowing device includes: an axial fan configured to generate an air flow to pass a heat exchanger; and a fan shroud housing the axial fan, the air flow generated by the axial fan passing through the fan shroud.

The fan shroud includes an air inlet part into which the air flow is introduced to pass the heat exchanger, the air inlet part having a shape corresponding to a peripheral shape of the heat exchanger, an air outlet part from which the air flow introduced into the air inlet part flows out, and a passage formation part that connects the air inlet part and the air outlet part with each other to define an air passage through which air introduced from the air inlet part flows to the air outlet part.

The passage formation part has at least one rib projected toward the heat exchanger. The rib is defined within a range corresponding to a narrow portion where the air inlet part and a peripheral part of the axial fan are close to each other in a radial direction of the axial fan.

Thus, when the rib is formed to project in the range concerning the narrow portion in the fan shroud, the distance between the rib and the peripheral part of the axial fan around the narrow portion can be made close to the distance between the rib and the peripheral part of the axial fan at the narrow portion.

Since a disturbance can be restricted from being generated in the air flow passing near the narrow portion, the pressure fluctuation near the peripheral side of the axial fan can be restricted from becoming extremely large at the narrow portion, compared with its circumferential location. As a result, the rotation noise of the blowing device can be reduced.

Furthermore, the rib is provided to project from the passage formation part of the fan shroud toward the heat exchanger, the outer shape of the fan shroud is not enlarged.

Therefore, the blowing device in which the rotation noise can be restricted is realized, without worsening the loading nature.

DESCRIPTION OF EMBODIMENTS

Figure 1:
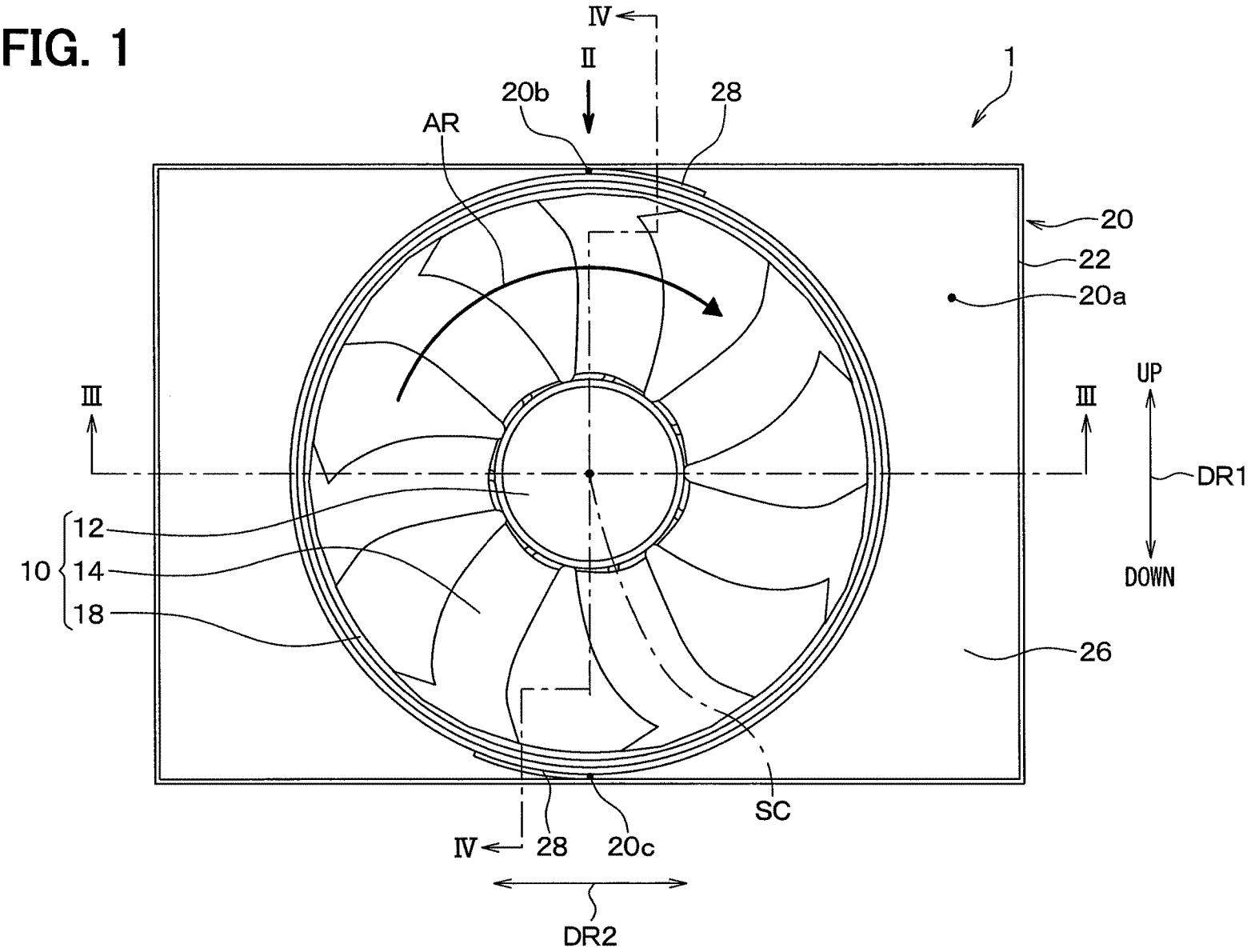
FIG. 1 is a schematic front view illustrating a blowing device according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A blowing device 1 of this embodiment is explained with reference to FIG. 1-FIG. 10. In each drawing, an arrow DR1, an arrow DR2, and an arrow DR3 represent directions when the blowing device 1 is mounted in a vehicle. That is, the arrow DR1 represents an up-down direction in the vehicle, the arrow DR2 represents a left-right direction in the vehicle (namely, a vehicle width direction), and the arrow DR3 represents a front-rear direction of the vehicle. AR illustrated in each drawing represents a rotational direction of an axial fan 10 to be mentioned later.

In this embodiment, the blowing device 1 of the present disclosure is applied to a device which supplies air outside of the vehicle to a radiator 2 to cool, for example, an engine of the vehicle. The radiator 2 is a heat exchanger in which heat is exchanged between a cooling water of the engine and the air outside of the vehicle.

Figure 2:
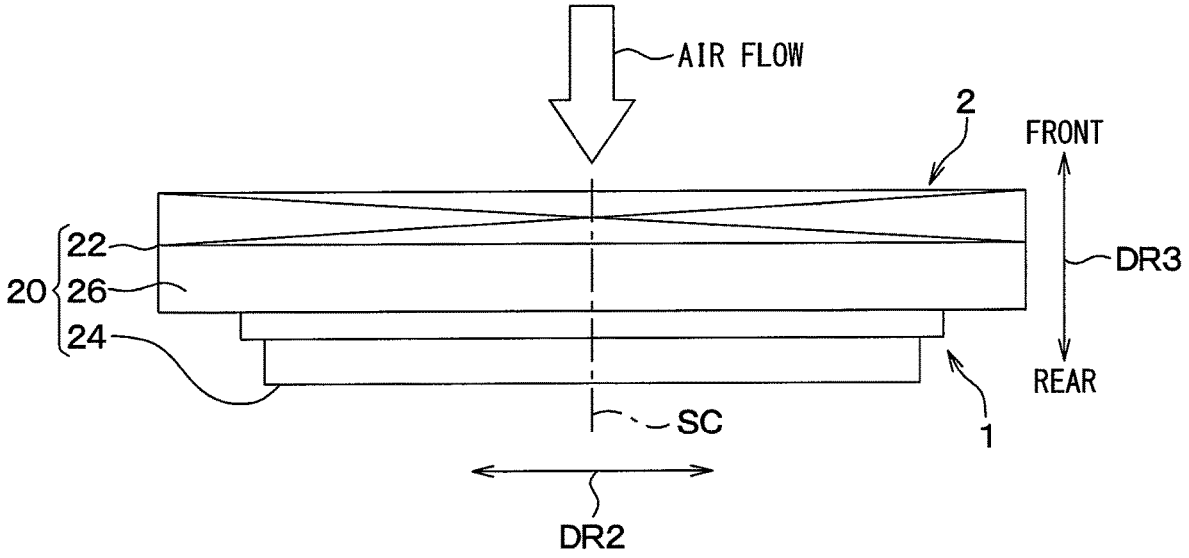
FIG. 2 is a view illustrating the blowing device seen in an arrow direction II of FIG. 1.

As shown in FIG. 2, the blowing device 1 of FIG. 1 is arranged on the rear side of the radiator 2. Specifically, the blowing device 1 is located downstream of the radiator 2 in the air flow so that the air which passed the radiator 2 is blown off rearward in the vehicle.

The blowing device 1 includes the axial fan 10, the fan shroud 20, and a non-illustrated electric motor that rotates the axial fan 10. The electric motor is fixed to the fan shroud 20 through a motor holder and a stay which are not illustrated.

The axial fan 10 has impellers arranged at the downstream side of the radiator 2 in the air flow, and generates the air flow to pass the radiator 2. The axial fan 10 is connected with a non-illustrated rotation shaft of the electric motor, and rotates in response to the rotations of the rotation shaft about an axial center SC which is a rotation center.

The axial fan 10 has a boss part 12 connected to rotate integrally with the rotation shaft of the electric motor, plural blades 14 extending from the axial center SC of the axial fan 10 in the radial direction, and a ring portion 18 arranged on the peripheral sides of the blades 14.

The blades 14 are prolonged from the boss part 12 in the radial direction. The blades 14 are arranged around the boss part 12 with a predetermined interval. The blades 14 of this embodiment are backswept wings, respectively.

The ring portion 18 is a component connecting the peripheral ends of the blades 14 in the circumferential direction of the axial fan 10. The ring portion 18 is a circular component has a center corresponding to the axial center SC of the axial fan 10. The ring portion 18 defines a peripheral side part of the axial fan 10 in this embodiment.

Each of the boss part 12, the blades 14, and the ring portion 18 of the axial fan 10 of this embodiment is made of resin, such as polypropylene. The boss part 12, the blades 14, and the ring portion 18 are produced as one-piece component formed by integral-molding.

The fan shroud 20 functions as a duct which introduces the air which passed the radiator 2 to the axial fan 10. The axial fan 10 is housed in the fan shroud 20. The air flow generated by the axial fan 10 passes through inside of the fan shroud 20. The fan shroud 20 of this embodiment is fixed to the radiator 2 by a fastening component such as a bolt. The fan shroud 20 of this embodiment is made of resin, such as polypropylene.

Figure 3:
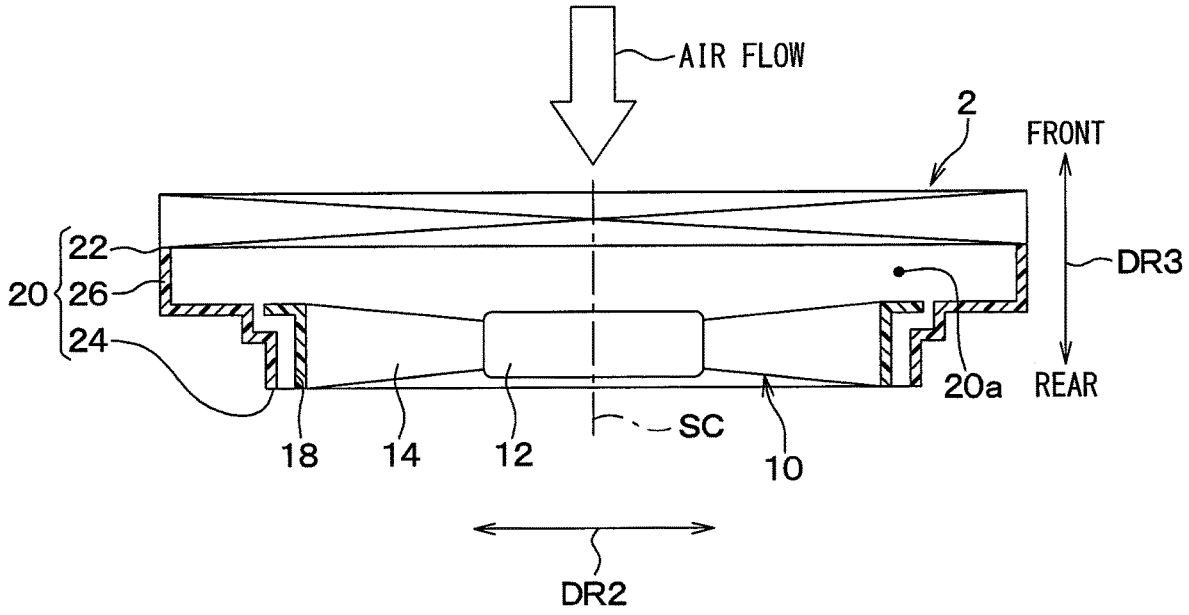
FIG. 3 is a cross-sectional view taken along a line III-III of FIG. 1.
Figure 4:
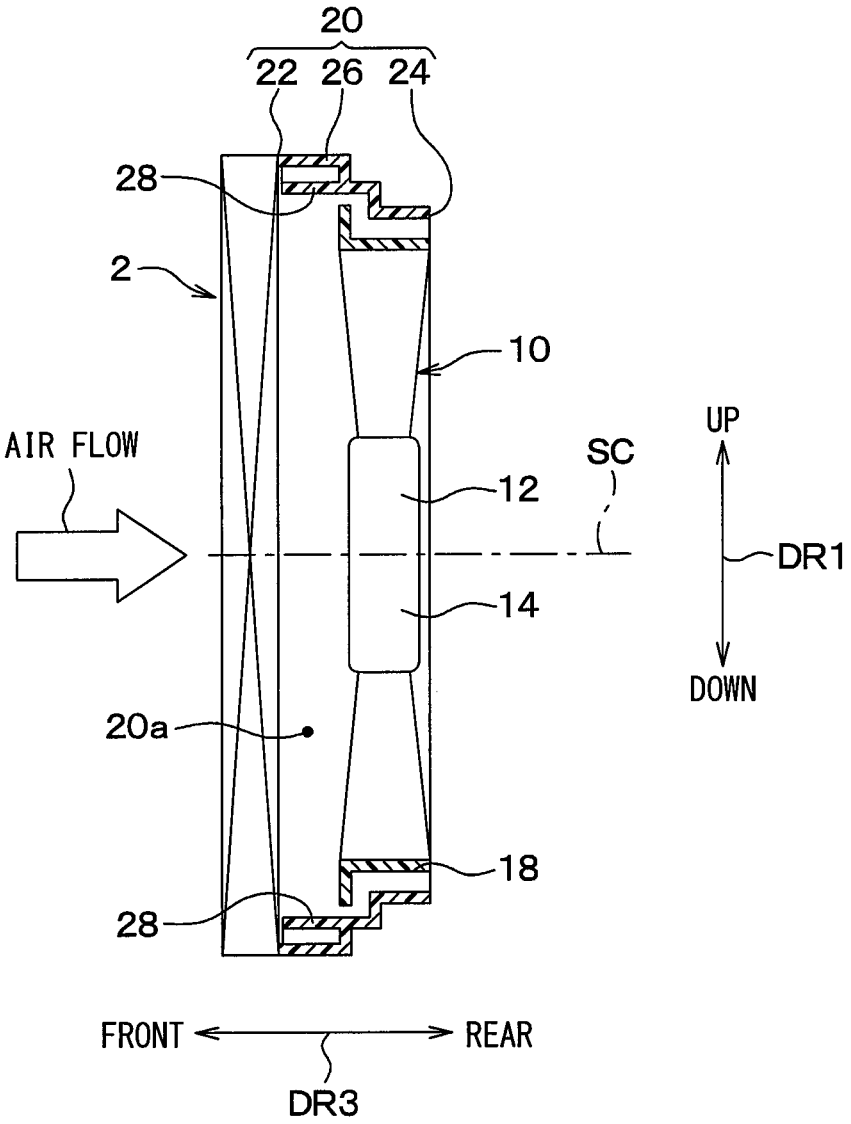
FIG. 4 is a cross-sectional view taken along a line IV-IV of FIG. 1.

As shown in FIG. 3 and FIG. 4, the fan shroud 20 includes an air inlet part 22, an air outlet part 24, and a passage formation part 26. The air inlet part 22, the passage formation part 26, and the air outlet part 24 of the fan shroud 20 are arranged in this order from the upstream side in the air flow.

The air inlet part 22 is a portion of the fan shroud 20 into which the air flow which passes the radiator 2 is introduced. The air inlet part 22 is located adjacent to the radiator 2 and is connected to the radiator 2. The air inlet part 22 has an open portion opposing the radiator 2 so that the air which passed the radiator 2 flows in.

The air inlet part 22 has a shape corresponding to the peripheral shape of the radiator 2. Specifically, the shape of the air inlet part 22 seen from the vehicle front-rear direction DR3 is a rectangle having a long side which extends in the vehicle width direction DR2, and a short side which extends in the vehicle up-down direction DR1.

The air outlet part 24 is a portion of the fan shroud 20 from which the air flow introduced from the air inlet part 22 flows out to the rear side of the vehicle. The axial fan 10 is arranged inside the air outlet part 24.

The air outlet part 24 is open so that the air flow introduced from the air inlet part 22 flows out. The air outlet part 24 of this embodiment is open at approximately central part of the fan shroud 20 in the vehicle width direction DR2. The opening area of the air outlet part 24 is smaller than the opening area of the air inlet part 22.

The air outlet part 24 has a shape surrounding the outer side of the axial fan 10. Specifically, the shape of the air outlet part 24 seen from the vehicle front-rear direction DR3 is a ring form corresponding to the outer shape of the axial fan 10. The air outlet part 24 is formed to have a predetermined clearance between the air outlet part 24 and the ring portion 18 of the axial fan 10 so that the axial fan 10 can rotate inside the air outlet part 24.

A non-illustrated stay is attached to the air outlet part 24 of this embodiment to support the motor holder holding the electric motor. The motor holder and the stay are formed integrally with the fan shroud 20.

As shown in FIG. 3 and FIG. 4, the passage formation part 26 connects the air inlet part 22 and the air outlet part 24 with each other, and forms the air passage 20*a* through which the air introduced from the air inlet part 22 at the upstream side in the air flow flows to the air outlet part 24 at the downstream side in the air flow.

The shape of the air inlet part 22 and the shape of the air outlet part 24 are different from each other in the fan shroud 20 of this embodiment. For this reason, in the blowing device 1 of this embodiment, a distance between the air inlet part 22 of the fan shroud 20 and the ring portion 18 of the axial fan 10 in the radial direction of the axial fan 10 is different depending on the position in the circumferential direction around the axial center SC of the axial fan 10. The radial direction of the axial fan 10 represents a direction perpendicular to the axial center SC of the axial fan 10.

The fan shroud 20 of this embodiment has narrow portions 20*b* and 20*c* where the air inlet part 22 and the ring portion 18 which is the peripheral part of the axial fan 10 are close to each other. The narrow portions 20*b* and 20*c* are located at the respective ends in the vehicle up-down direction DR1 and approximately central part in the vehicle width direction DR2. That is, the two narrow portions 20*b* and 20*c* are formed in the fan shroud 20 of this embodiment. The narrow portion 20*b*, 20*c* can be interpreted as a portion where the distance between the air inlet part 22 and the ring portion 18 is the minimum in the radial direction of the axial fan 10.

Figure 5:
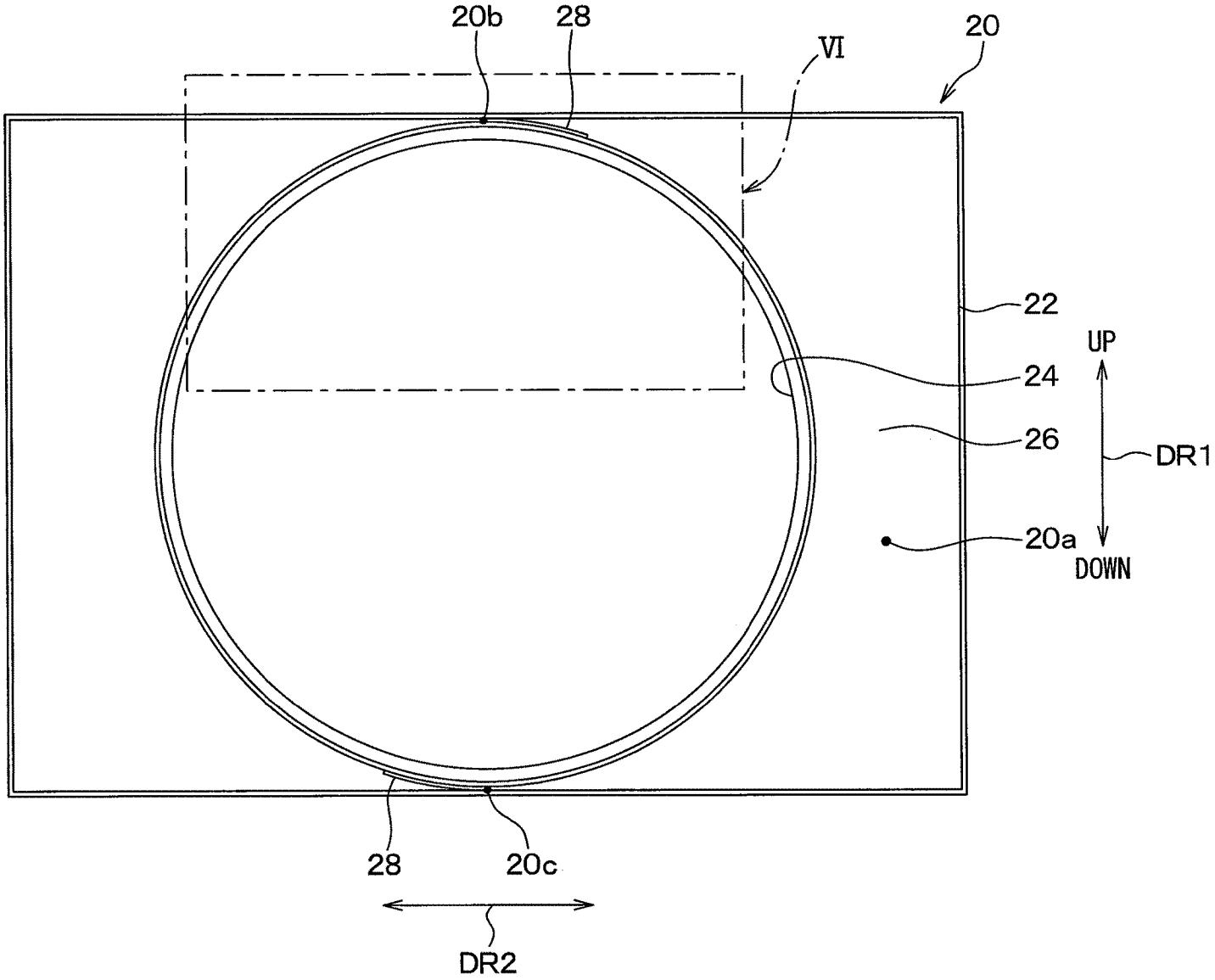
FIG. 5 is a schematic front view illustrating a fan shroud of the first embodiment.

As shown in FIG. 1, FIG. 4, and FIG. 5, in the blowing device 1 of this embodiment, the passage formation part 26 of the fan shroud 20 has a rib 28 projected toward the radiator 2 on the upstream side in the air flow, within a range corresponding to the narrow portion 20*b*, 20*c*.

The rib 28 of this embodiment is formed within the range from the narrow portion 20*b*, 20*c* in the passage formation part 26 to a location advanced in the rotational direction AR than the narrow portion 20*b*, 20*c*. The rib 28 is formed within the range having a predetermined angle, for example (about 5 degrees to about 20 degrees) advanced in the rotational direction AR from the narrow portion 20*b*, 20*c*. The rib 28 is not formed in an area where the air inlet part 22 and the ring portion 18 of the axial fan 10 are most distant from each other in the radial direction of the axial fan 10.

The rib 28 of this embodiment has a shape curved along the peripheral part of the air outlet part 24. Specifically, the rib 28 has an arc shape having a center corresponding to the axial center SC of the axial fan 10. The distance between the rib 28 and the ring portion 18 around the narrow portion 20*b*, 20*c* is approximately the same as the distance between the rib 28 and the ring portion 18 at the narrow portion 20*b*, 20*c*.

Figure 6:
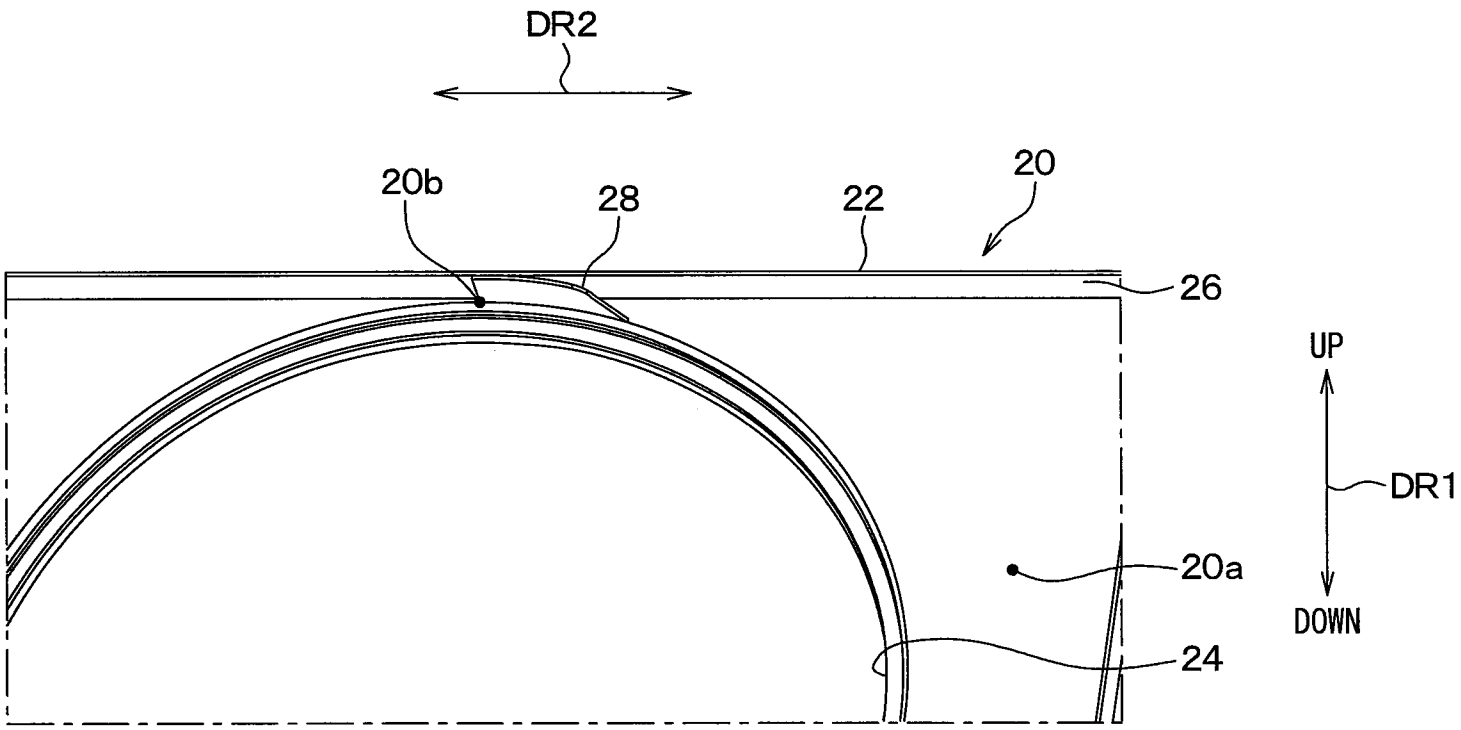
FIG. 6 is a perspective view illustrating a VI section of FIG. 5.

The rib 28 of this embodiment has a height in the axial direction of the axial fan 10 not to be in contact with the radiator 2, such that the outer shape of the fan shroud 20 does not become large. As shown in FIG. 6, the height of the rib 28 in the axial direction of the axial fan 10 is reduced as separating from the narrow portion 20*b*, 20*c*. Specifically, the rib 28 of this embodiment is shaped such that the end of the rib 28 in the circumferential direction is tapered.

Next, the operation of the blowing device 1 of this embodiment is explained. The axial fan 10 of the blowing device 1 rotates in response to rotation of the rotation shaft of the electric motor which is not illustrated. Thereby, the air drawn by the axial fan 10 from the radiator 2 is blown off rearward along the extension direction of the axial center SC of the axial fan 10, i.e., the axial direction of the axial fan 10.

Figure 7:
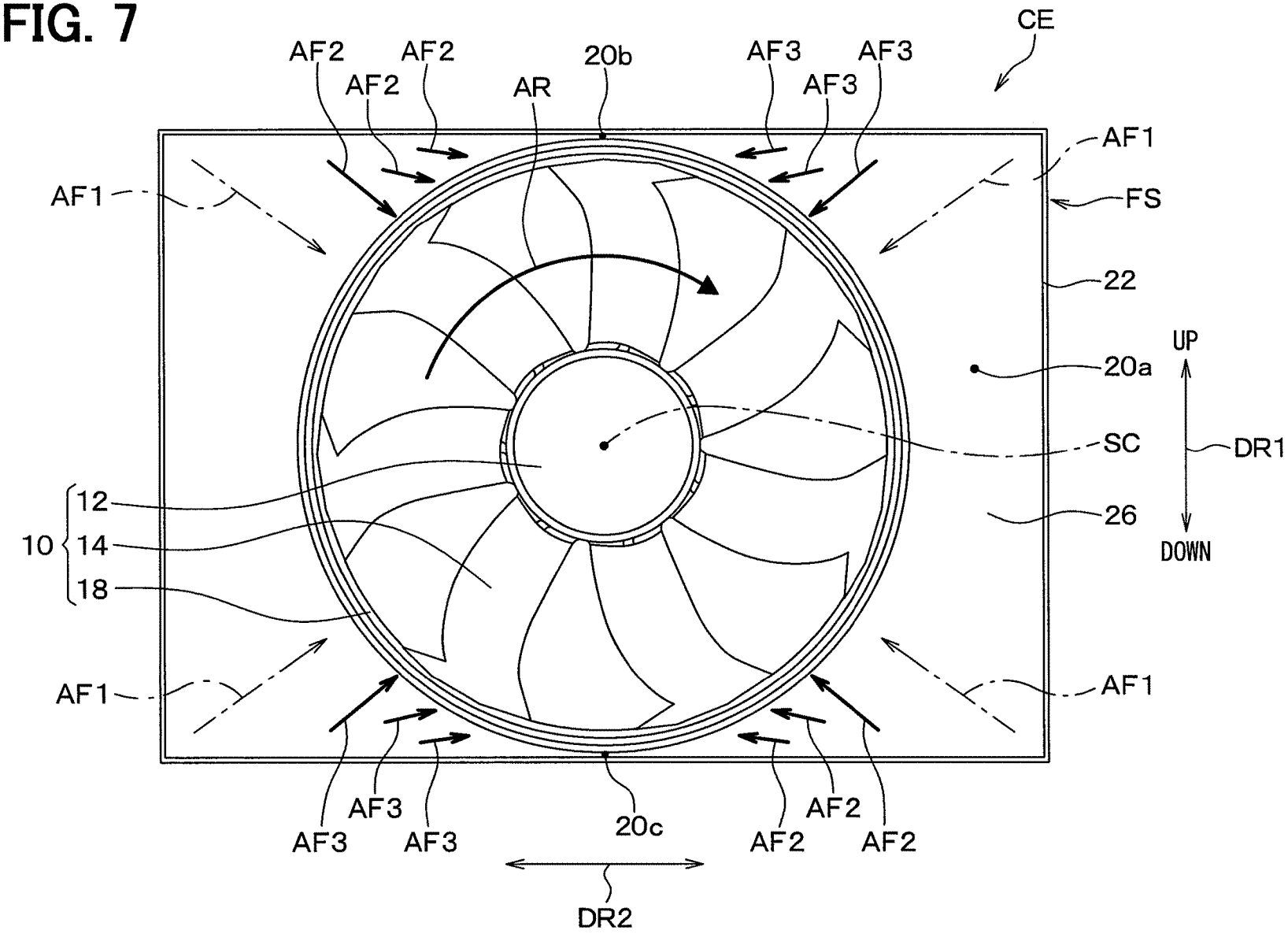
FIG. 7 is a diagram for explaining flows of air near a narrow portion of a fan shroud of a blowing device in a comparative example.

FIG. 7 is a schematic front view illustrating a blowing device CE of a comparative example in contrast to this embodiment. Compared with the blowing device 1 of this embodiment, the rib 28 is not formed in a fan shroud FS of the blowing device CE in the comparative example. The same referential mark is given to the same configuration as the blowing device 1 of this embodiment, for convenience, for the blowing device CE of the comparative example, in FIG. 7.

In the blowing device CE of the comparative example, the air drawn from the radiator 2 by the axial fan 10 is blown off rearward along the axial direction of the axial fan 10, in response to the rotation of the axial fan 10. At this time, as shown in a single chain line arrow AF1 of FIG. 7, in the blowing device CE of the comparative example, a transverse direction flow becomes dominant as the air flow inside the fan shroud FS.

Disturbance is easily produced in the air flow by collision between the air flows which flow in the transverse direction, at the position near the narrow portion 20*b*, 20*c* of the fan shroud FS. If the disturbed air flow collides with the blade 14 of the axial fan 10, a periodic pressure fluctuation becomes large to lead the rotation noise. The rotation noise produced by the rotation of the axial fan 10 is also called as BPF (Blade Passing Frequency) noise.

According to the inventors' examination, the pressure fluctuation produced near the narrow portion 20*b*, 20*c* of the fan shroud FS is more easily generated within the range advanced from the narrow portion 20*b*, 20*c* in the rotational direction AR than in the narrow portion 20*b*, 20*c*.

Specifically, in an area behind the narrow portion 20*b*, 20*c* in the rotational direction AR, as shown in a thick line arrow AF2 of FIG. 7, the direction of air flow is along the rotational direction AR of the axial fan 10.

In contrast, in an area advanced in the rotational direction AR than the narrow portion 20*b*, 20*c*, as shown in a thick line arrow AF3 of FIG. 7, the direction of air flow is opposite from the rotational direction AR of the axial fan 10.

In the area advanced in the rotational direction AR than the narrow portion 20*b*, 20*c*, compared with the area behind the narrow portion 20*b*, 20*c* in the rotational direction AR, a relative speed of the air flow to the axial fan 10 is large, such that the pressure (namely, sound pressure) easily declines.

Figure 8:
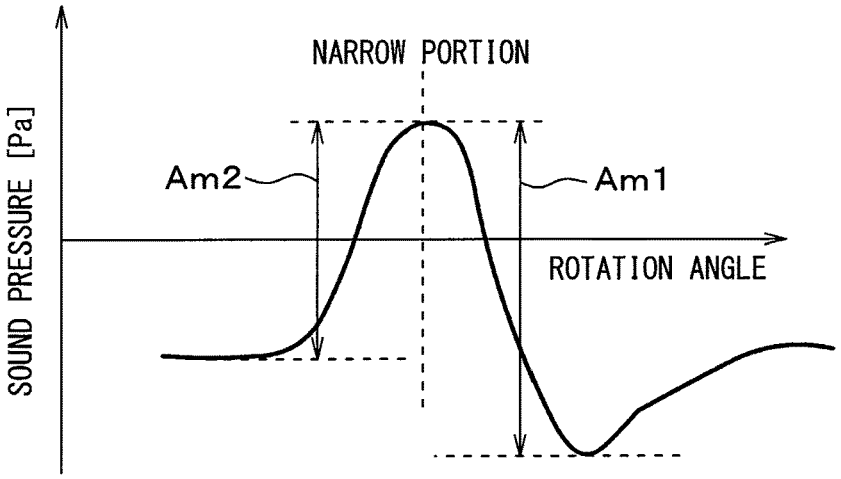
FIG. 8 is a diagram for explaining change in sound pressure near the narrow portion of the fan shroud of the blowing device in the comparative example.

For this reason, as shown in FIG. 8, in the area advanced in the rotational direction AR than the narrow portion 20*b*, 20*c*, there is a tendency that an amplitude Am1 of sound pressure becomes large compared with an amplitude Am2 of sound pressure in the area behind the narrow portion 20*b*, 20*c* in the rotational direction AR.

In contrast, according to this embodiment, the blowing device 1 has the rib 28 of the fan shroud 20 projected within the range corresponding to the narrow portion 20*b*, 20*c*. For this reason, the distance between the rib 28 and the ring portion 18 of the axial fan 10 around the narrow portion 20*b*, 20*c* becomes close to the distance between the rib 28 and the ring portion 18 of the axial fan 10 at the narrow portion 20*b*, 20*c*.

Since the disturbance can be suppressed in the air flow which flows into the axial fan 10 from the adjacency of the narrow portion 20*b*, 20*c*, the pressure fluctuation near the peripheral side of the axial fan 10 at the narrow portion 20*b*, 20*c* can be restricted from becoming extremely large, compared with the circumference of the narrow portion 20*b*, 20*c*.

Figure 9:
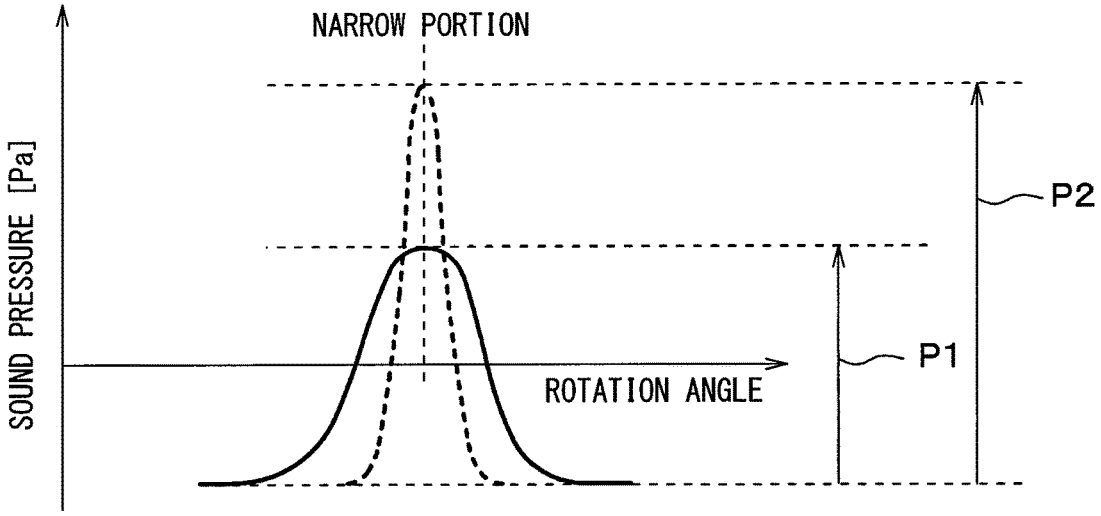
FIG. 9 is a diagram for explaining change in sound pressure near a narrow portion of the fan shroud of the blowing device of the first embodiment.

FIG. 9 is a diagram for explaining change in the sound pressure near the narrow portion 20*b*, 20*c* of the fan shroud 20 of the blowing device 1 of this embodiment. In FIG. 9, a solid line A represents change in the sound pressure near the narrow portion 20*b*, 20*c* of the blowing device 1 of this embodiment, and a dashed line B represents change in the sound pressure near the narrow portion 20*b*, 20*c* of the blowing device CE of the comparative example.

As shown in FIG. 9, according to the blowing device 1 of this embodiment, the peak value P1 of the sound pressure near the narrow portion 20*b*, 20*c* is smaller than the peak value P2 of the sound pressure of the narrow portion 20*b*, 20*c* of the blowing device CE of the comparative example. That is, according to the characteristic shown in FIG. 9, compared with the blowing device CE of the comparative example, the blowing device 1 of this embodiment can reduce the pressure fluctuation which causes the BPF noise.

Figure 10:
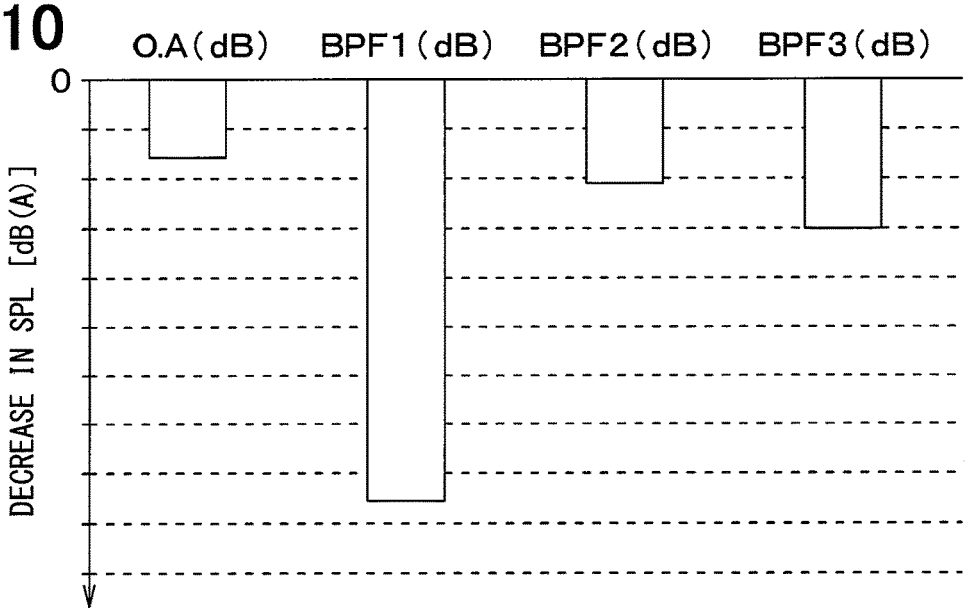
FIG. 10 is a characteristic view illustrating a decrease in sound pressure level in the blowing device of the first embodiment relative to the blowing device of the comparative example.

FIG. 10 illustrates a decrease in the sound pressure level SPL (Sound Pressure Level) when rotating the axial fan 10 in the blowing device 1 of this embodiment, relative to the blowing device CE of the comparative example. Specifically, FIG. 10 illustrates the O.A. (Over All) decrease amount in SPL, and the decrease amount in SPL for every tracking order component of rotation. In FIG. 10, BPF1 represents a primary order component of rotation, BPF2 represents a secondary order component of rotation, and BPF3 represents a third order component of rotation. In addition, O.A. is a product sum of SPL of the total frequency.

As shown in FIG. 10, O.A. of SPL by the blowing device 1 of this embodiment is smaller, compared with SPL by the blowing device CE of the comparative example. In other words, the noise reduction effect is acquired in this embodiment, as a whole, compared with the comparative example. In particular, in the blowing device 1 of this embodiment, the noise reduction effect is large in BPF1.

The blowing device 1 of this embodiment has the rib 28 projected within the range corresponding to the narrow portion 20*b*, 20*c* in the fan shroud 20. The pressure fluctuation near the peripheral side of the axial fan 10 can be suppressed from becoming extremely large at the narrow portion 20*b*, 20*c* compared with the circumference. Therefore, the rotation noise of the blowing device 1 can be reduced.

Furthermore, the rib 28 of this embodiment is provided to the passage formation part 26 of the fan shroud 20 to project toward the radiator 2 at the upstream side in the air flow. Therefore, the outer shape of the fan shroud 20 is restricted from becoming large.

Therefore, according to the blowing device 1 of this embodiment, it becomes possible to control the rotation noise, i.e., BPF noise, without worsening the loading nature to the vehicle.

Moreover, in this embodiment, the rib 28 has the curved shape along the peripheral part of the air outlet part 24. Accordingly, the distance between the rib 28 and the ring portion 18 of the axial fan 10 around the narrow portion 20*b*, 20*c* can be made approximately the same as the distance between the rib 28 and the ring portion 18 at the narrow portion 20*b*, 20*c*. For this reason, the pressure fluctuation near the peripheral side of the axial fan 10 can fully be suppressed from becoming extremely large at the narrow portion 20*b*, 20*c*, compared with the circumference.

Furthermore, in this embodiment, the rib 28 is formed within the range advanced in the rotational direction AR of the axial fan 10 from the narrow portion 20*b*, 20*c* in the fan shroud 20. Accordingly, the pressure fluctuation near the peripheral side of the axial fan 10 can be suppressed effectively.

Furthermore, in this embodiment, the height of the rib 28 is reduced as separating from the narrow portion 20*b*, 20*c*. Accordingly, a disturbance in the air flow, which becomes a generating factor of a new noise, can be restricted at the boundary between a portion in which the rib 28 is formed and a portion in which the rib 28 is not formed in the fan shroud 20.

Modification of First Embodiment

In the first embodiment, the rib 28 is formed on the passage formation part 26 within the range from the narrow portion 20*b*, 20*c* to be advanced in the rotational direction AR from the narrow portion 20*b*, 20*c*, but is not limited to this.

Figure 11:
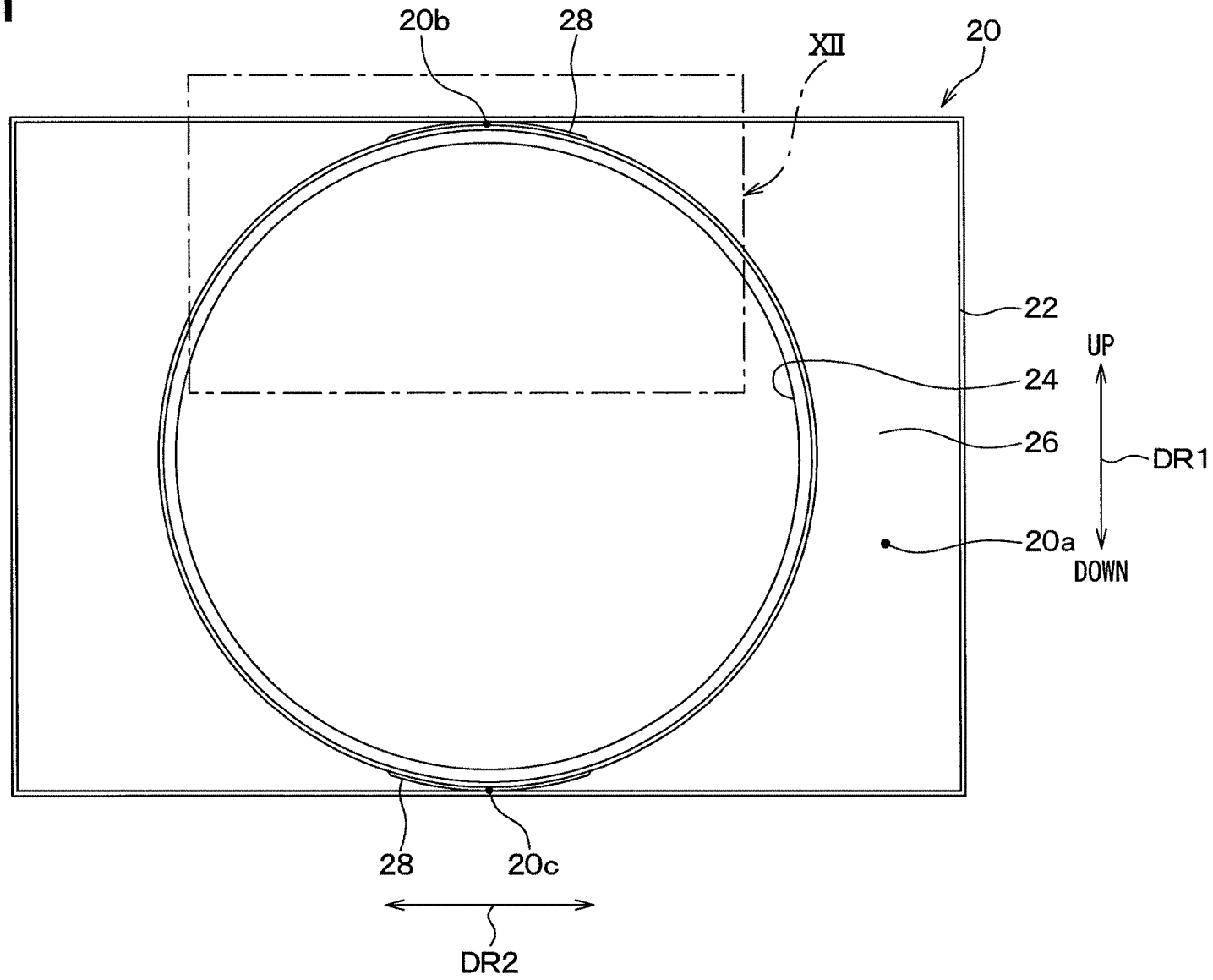
FIG. 11 is a schematic front view illustrating a modification of the fan shroud of the blowing device of the first embodiment.
Figure 12:
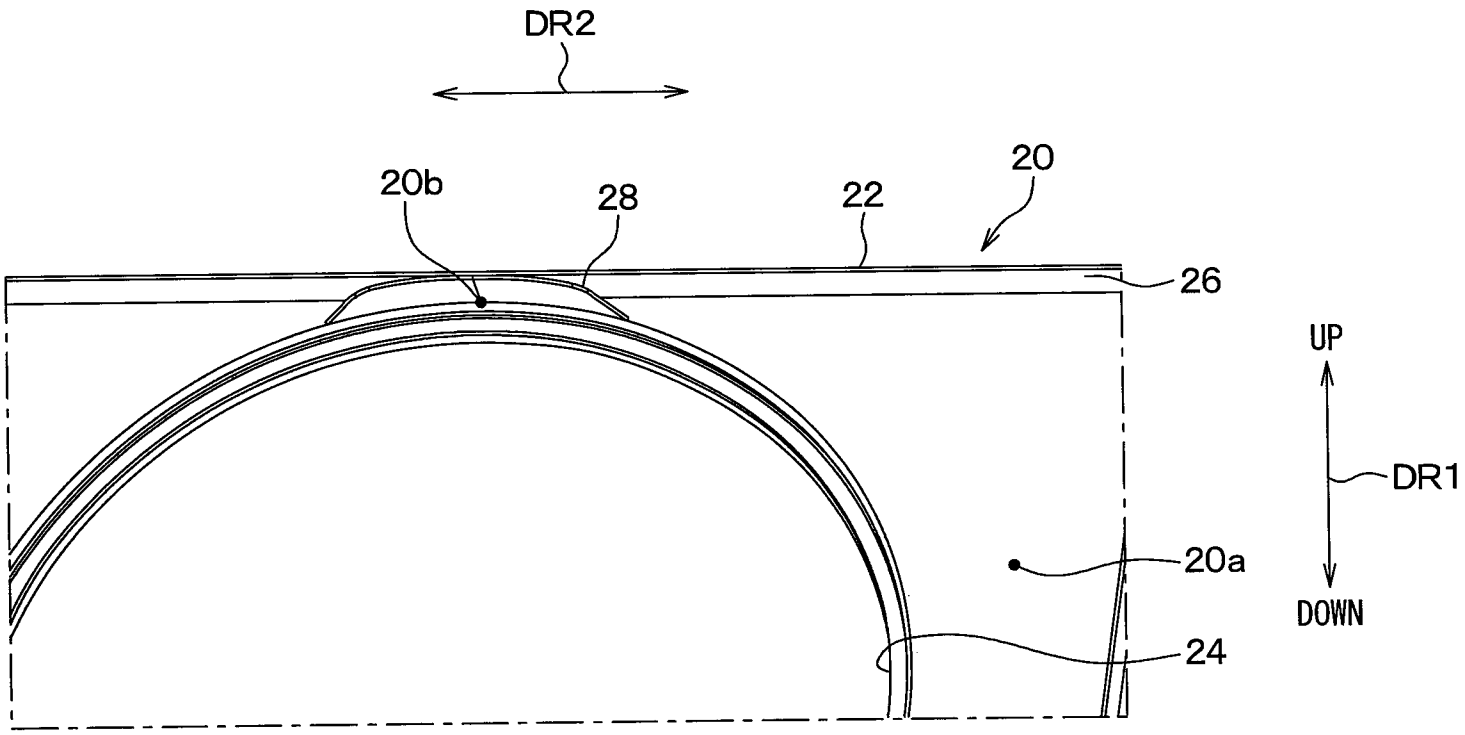
FIG. 12 is a perspective view illustrating a XII section of FIG. 11.

As shown in FIG. 11 and FIG. 12, the blowing device 1 may have the rib 28 on the passage formation part 26, within a range from a portion behind the narrow portion 20*b*, 20*c* in the rotational direction AR and to a portion advanced in the rotational direction AR from the narrow portion 20*b*, 20*c*.

According to the blowing device 1 modified in this way, it is possible to control the rotation noise, i.e., BPF noise, without worsening the loading nature to the vehicle, similarly to the blowing device 1 of the first embodiment.

Second Embodiment

A second embodiment is described with reference to FIG. 13 and FIG. 14, in which the air outlet part 24 of the fan shroud 20 is located offset to one side in the vehicle width direction.

Figure 13:
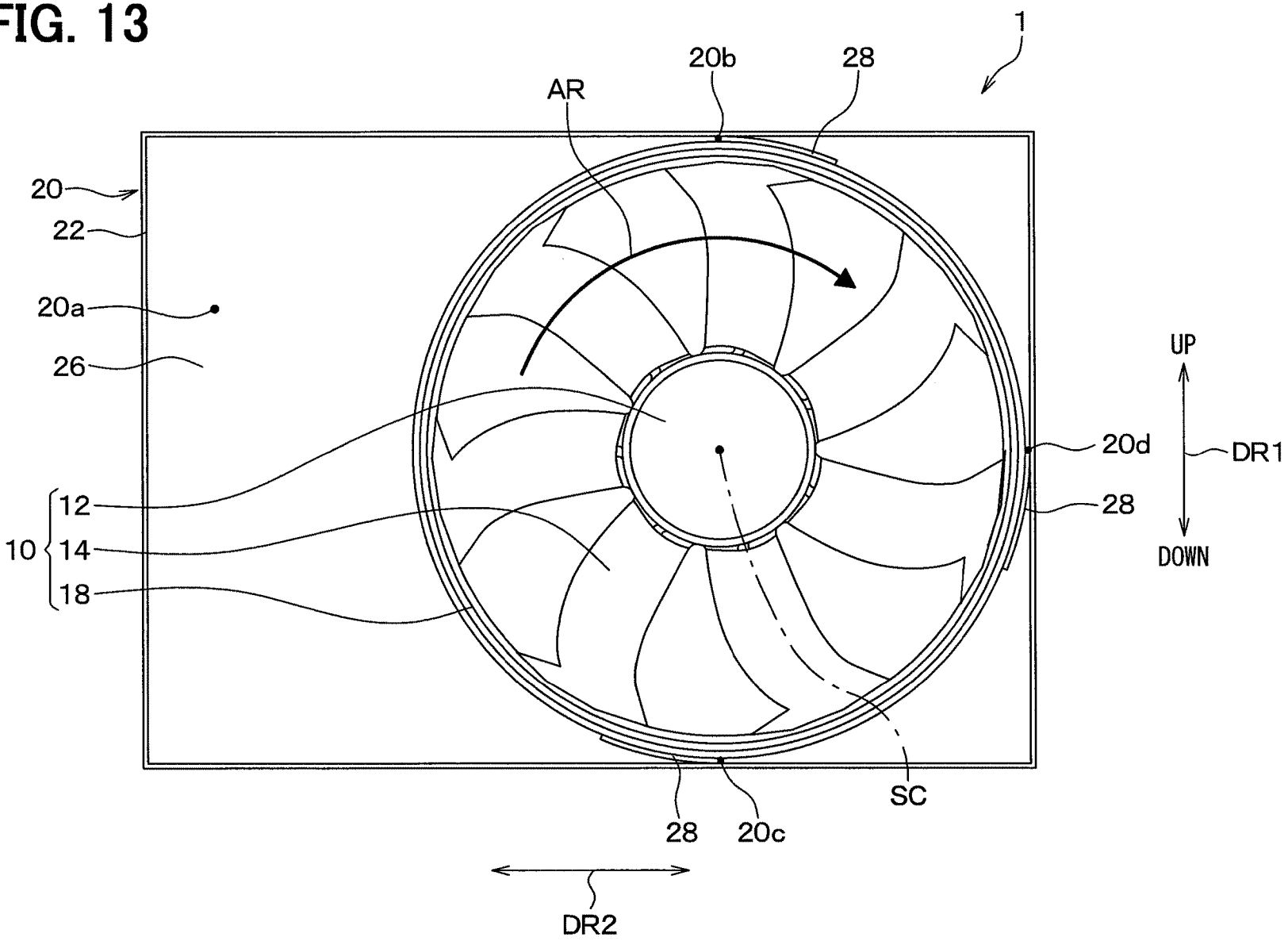
FIG. 13 is a schematic front view illustrating a blowing device according to a second embodiment.
Figure 14:
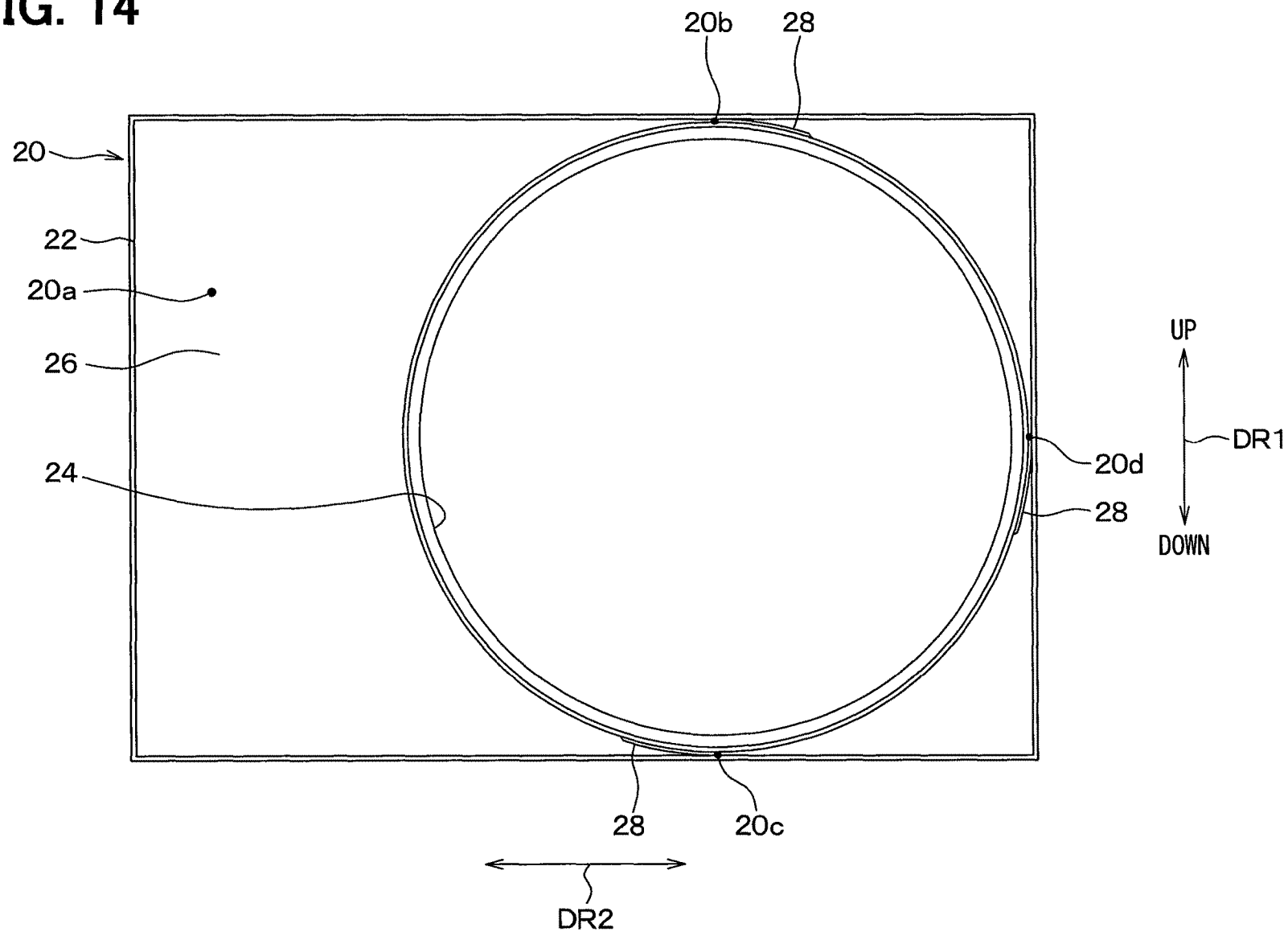
FIG. 14 is a schematic front view illustrating a fan shroud of the second embodiment.

As shown in FIG. 13 and FIG. 14, the air outlet part 24 of this embodiment is open at the position offset to one side in the vehicle width direction DR2 in the fan shroud 20. Specifically, the air outlet part 24 of this embodiment is open so that a part of the air outlet part 24 is located adjacent to one short side of the air inlet part 22.

The fan shroud 20 of this embodiment has the narrow portions 20*b*, 20*c* located at the respective ends in the vehicle up-down direction DR1, and approximately central part in the vehicle width direction DR2. The fan shroud 20 of this embodiment has a narrow portion 20*d* located at one end in the vehicle width direction DR2, and approximately central part in the vehicle up-down direction DR1. That is, the three narrow portions 20*b*, 20*c*, and 20*d* are formed in the fan shroud 20 of this embodiment.

The passage formation part 26 of the fan shroud 20 has the rib 28 projected toward the radiator 2 on the upstream side in the air flow, within the range corresponding to the narrow portion 20*b*, 20*c*, 20*d* in the blowing device 1 of this embodiment.

The rib 28 of this embodiment is formed on the passage formation part 26 within the range from the narrow portion 20*b*, 20*c*, 20*d* to a location advanced in the rotational direction AR than the narrow portion 20*b*, 20*c*, 20*d*. The rib 28 is not formed in a location where the air inlet part 22 and the ring portion 18 of the axial fan 10 are most distant from each other in the radial direction of the axial fan 10.

The other structure is the same as that of the first embodiment. The blowing device 1 of this embodiment can acquire the action and effect common as the blowing device 1 of the first embodiment.

In this embodiment, the rib 28 is provided to correspond to each of the three narrow portions 20*b*, 20*c*, 20*d* in the fan shroud 20. Since the pressure fluctuation near the peripheral side of the axial fan 10 can be suppressed in the narrow portions 20*b*, 20*c*, 20*d*, the rotation noise of the blowing device 1 can be effectively reduced.

Modification of Second Embodiment

In the second embodiment, the rib 28 is provided on the passage formation part 26 within the range from the narrow portion 20*b*, 20*c*, 20*d* and advanced in the rotational direction AR than the narrow portion 20*b*, 20*c*, 20*d*, but is not limited to this.

Figure 15:
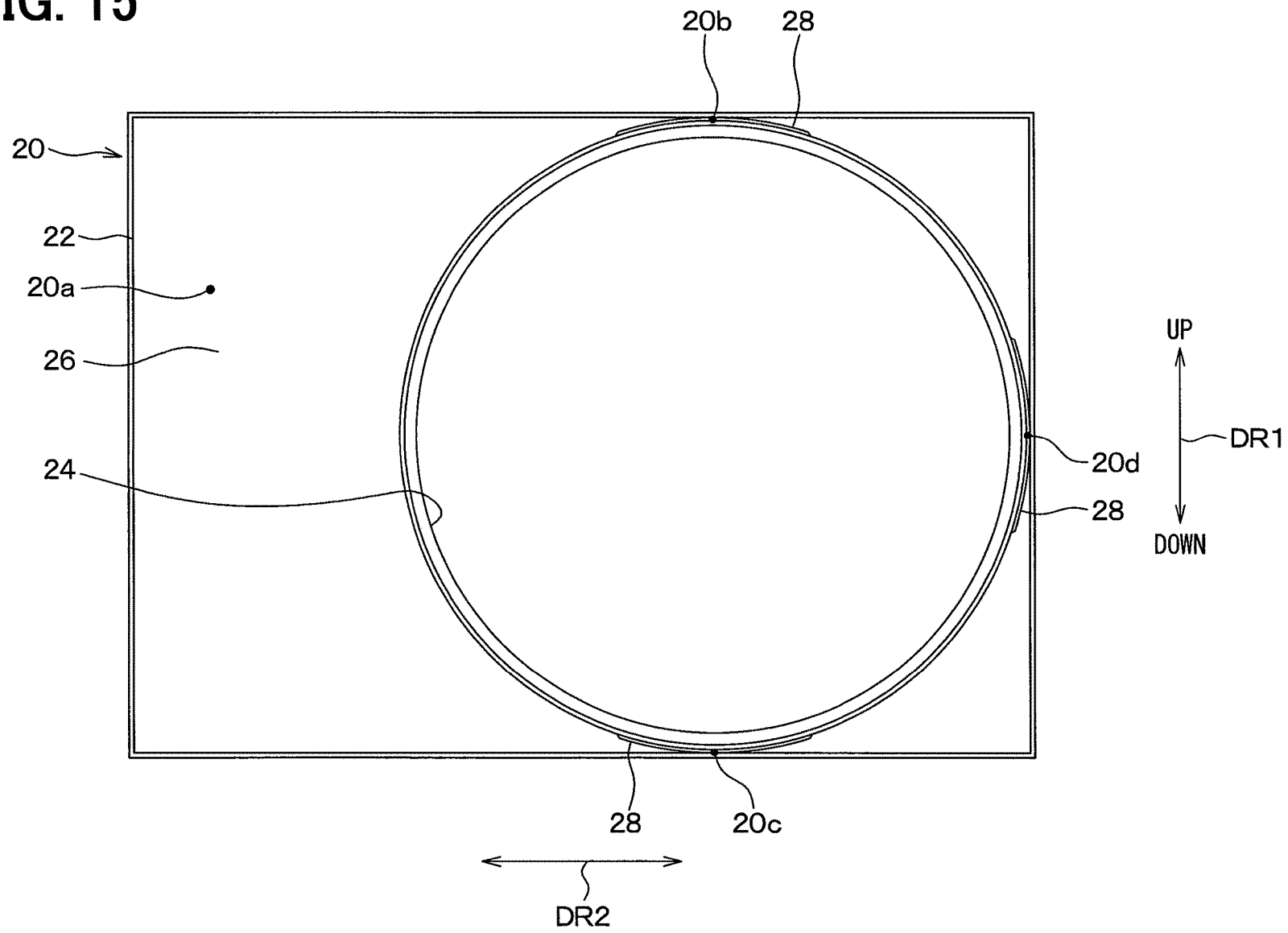
FIG. 15 is a schematic front view illustrating a modification of the fan shroud of the blowing device of the second embodiment.

As shown in FIG. 15, according to a modification of the second embodiment, the blowing device 1 has the rib 28 within the range from a location behind the narrow portion 20*b*, 20*c*, 20*d* in the rotational direction AR to a location advanced from the narrow portion 20*b*, 20*c*, 20*d* in the rotational direction AR.

According to the blowing device 1 modified in this way, it is possible to control the rotation noise, i.e., BPF noise, without worsening the loading nature to the vehicle, similarly to the blowing device 1 of the second embodiment.

Third Embodiment

Figure 16:
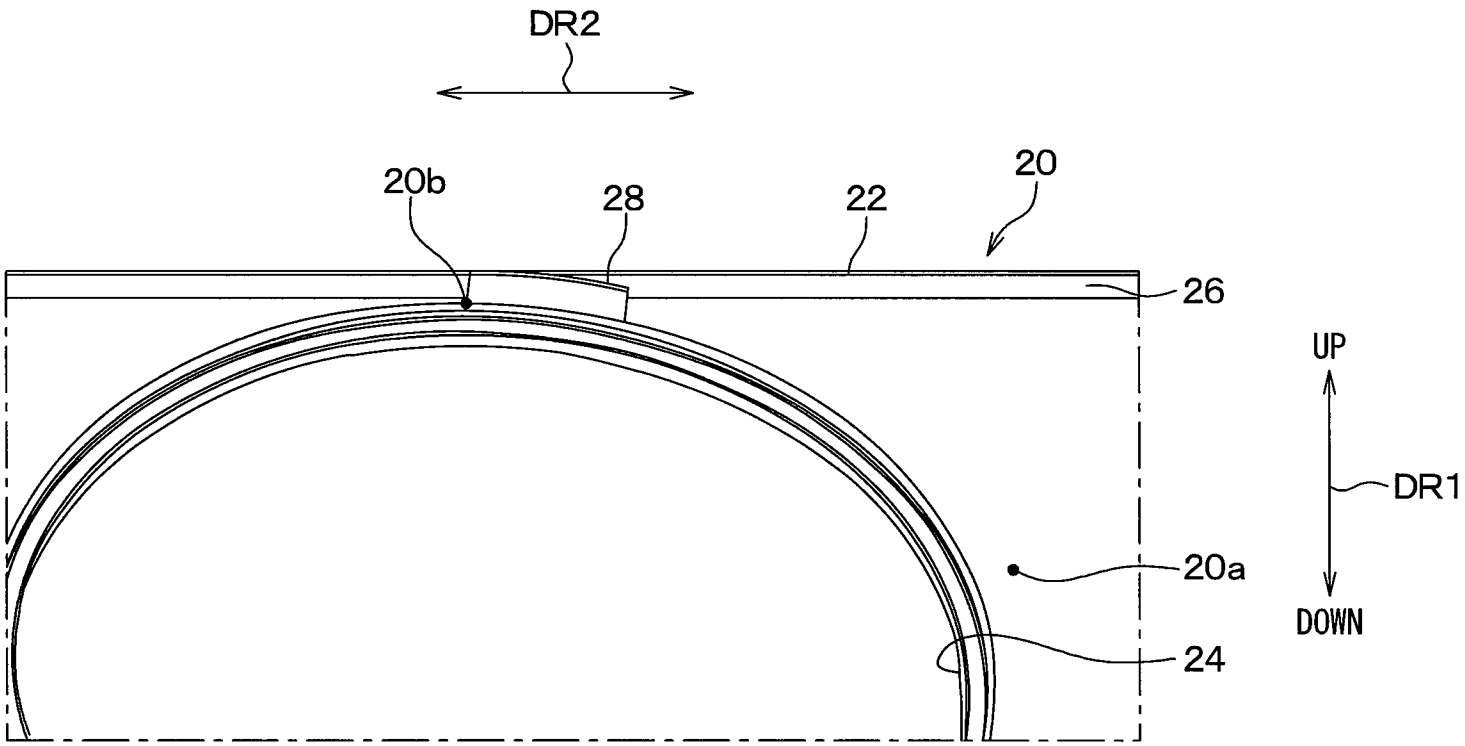
FIG. 16 is a perspective view illustrating a narrow portion of a fan shroud according to a third embodiment.

A third embodiment is described with reference to FIG. 16. FIG. 16 is a perspective view illustrating the narrow portion 20*b* of the fan shroud 20 of this embodiment. FIG. 16 is a view corresponding to FIG. 5 of the first embodiment.

As shown in FIG. 16, the height of the rib 28 in the axial direction of the axial fan 10 has a uniform size in the circumferential direction. That is, the end of the rib 28 in the circumferential direction is not tapered, differently from the first embodiment.

The other structure is the same as that of the first embodiment. The blowing device 1 of this embodiment can acquire the action and effect common as the blowing device 1 of the first embodiment.

Fourth Embodiment

Figure 17:
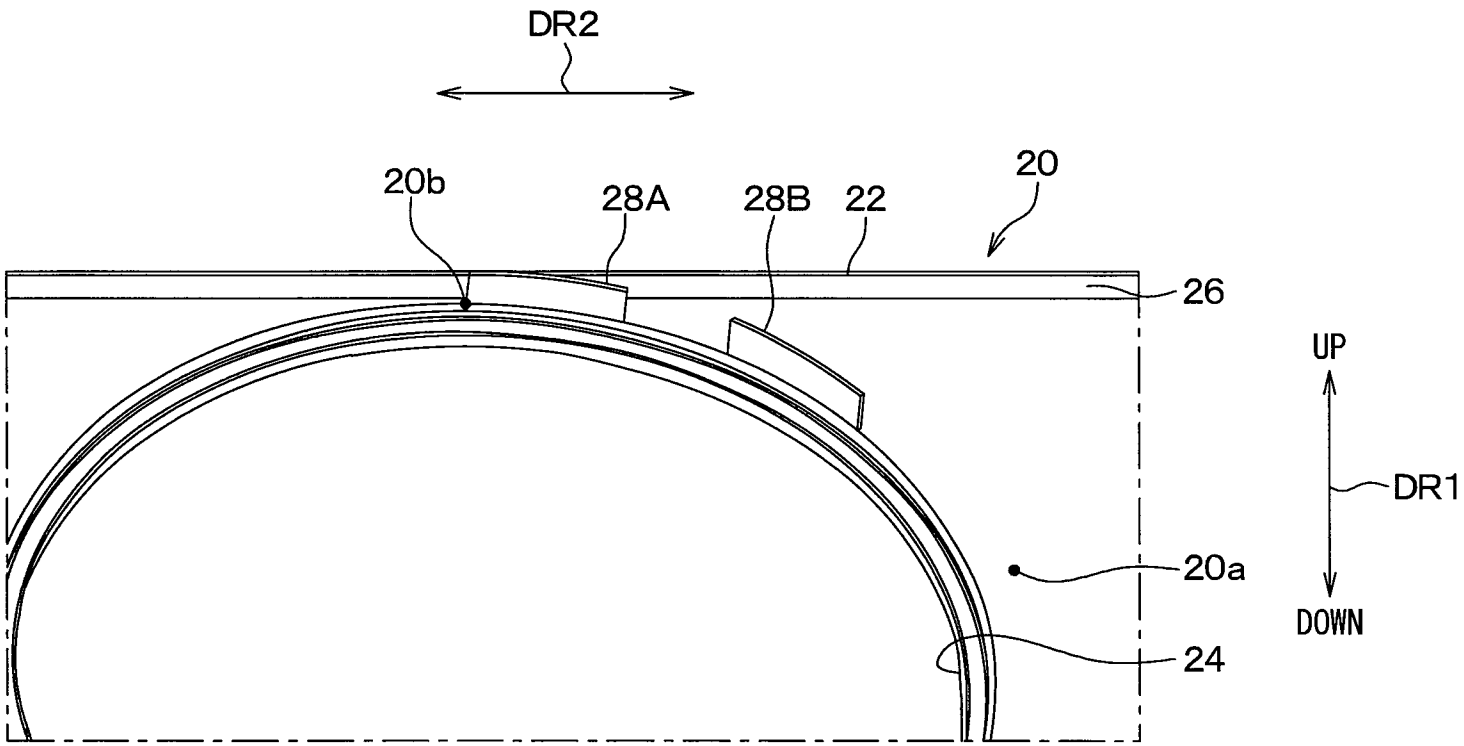
FIG. 17 is a perspective view illustrating a narrow portion of a fan shroud according to a fourth embodiment.

A fourth embodiment is described with reference to FIG. 17. FIG. 17 is a perspective view illustrating the narrow portion 20*b* of the fan shroud 20 of this embodiment. FIG. 17 is a view corresponding to FIG. 5 of the first embodiment.

As shown in FIG. 17, the fan shroud 20 of this embodiment has two ribs 28A and 28B formed on the passage formation part 26, within the range from the narrow portion 20*b*, 20*c* and advanced in the rotational direction AR from the narrow portion 20*b*, 20*c*.

The first rib 28A is located within the range, in the passage formation part 26, from the narrow portion 20*b*, 20*c* and advanced in the rotational direction AR from the narrow portion 20*b*, 20*c*. The first rib 28A has a shape curved along the peripheral part of the air outlet part 24.

The second rib 28B is located to space from the first rib 28A in the circumferential direction. Specifically, the second rib 28B is located at the position advanced in the rotational direction AR than the first rib 28A.

The second rib 28B has a shape curved along the peripheral part of the air outlet part 24. The second rib 28B has the shape similar to the first rib 28A, although the position of the second rib 28B is different from that of the first rib 28A in the fan shroud 20.

The other structure is the same as that of the first embodiment. The blowing device 1 of this embodiment can acquire the action and effect common as the blowing device 1 of the first embodiment.

In this embodiment, since the fan shroud 20 has the plural ribs 28A and 28B, a disturbance can be suppressed in the air flow which flows into the axial fan 10 from the adjacency of the narrow portion 20*b*, 20*c*.

In this embodiment, the two ribs 28A and 28B are formed in the range from the narrow portion 20*b*, 20*c* and advanced in the rotational direction AR than the narrow portion 20*b*, 20*c*, in the passage formation part 26, but are not limited to. The blowing device 1 may have, for example, three or more ribs 28 formed near the narrow portion 20*b*, 20*c* in the passage formation part 26.

Fifth Embodiment

Figure 18:
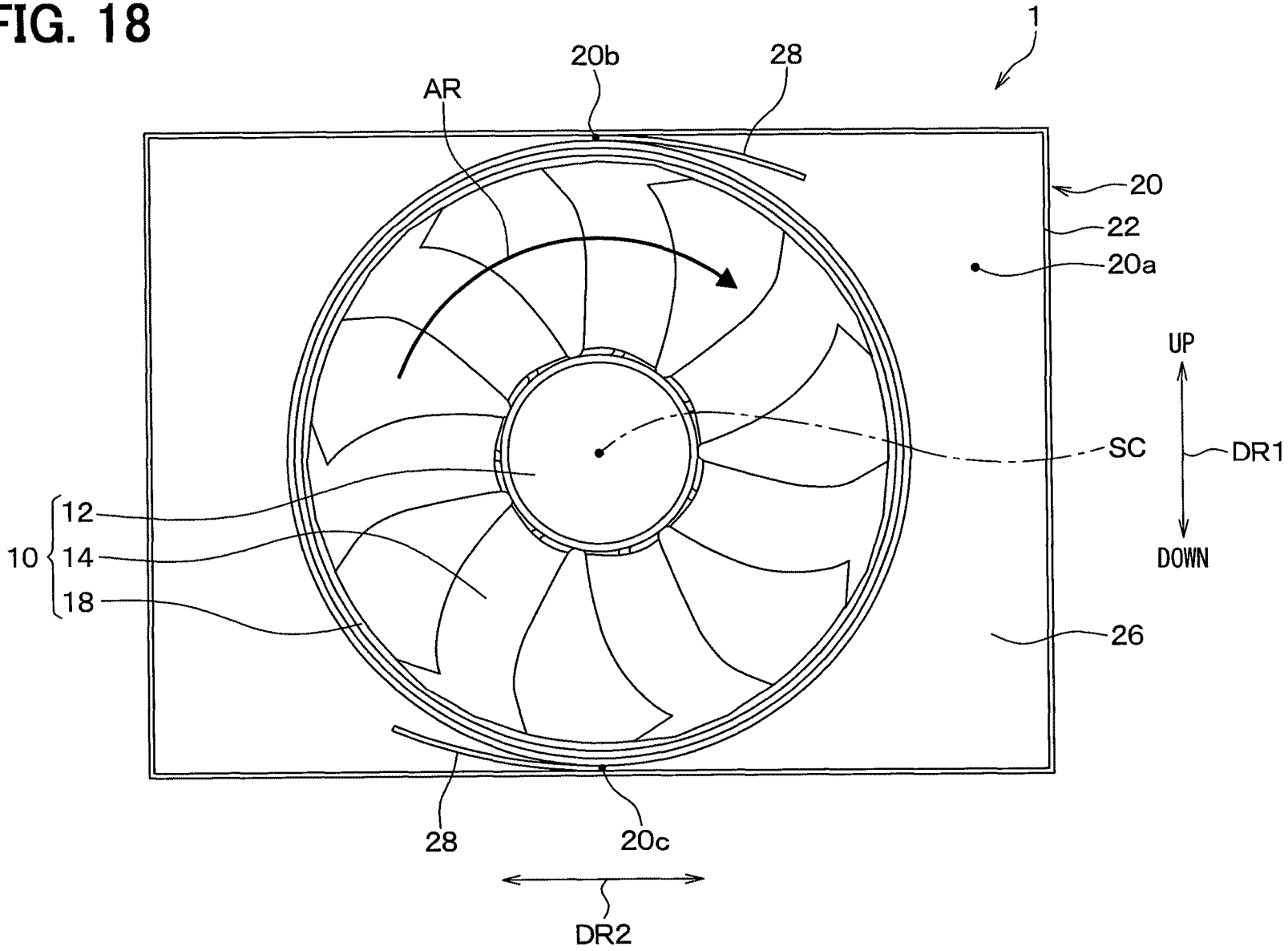
FIG. 18 is a schematic front view illustrating a blowing device according to a fifth embodiment.
Figure 19:
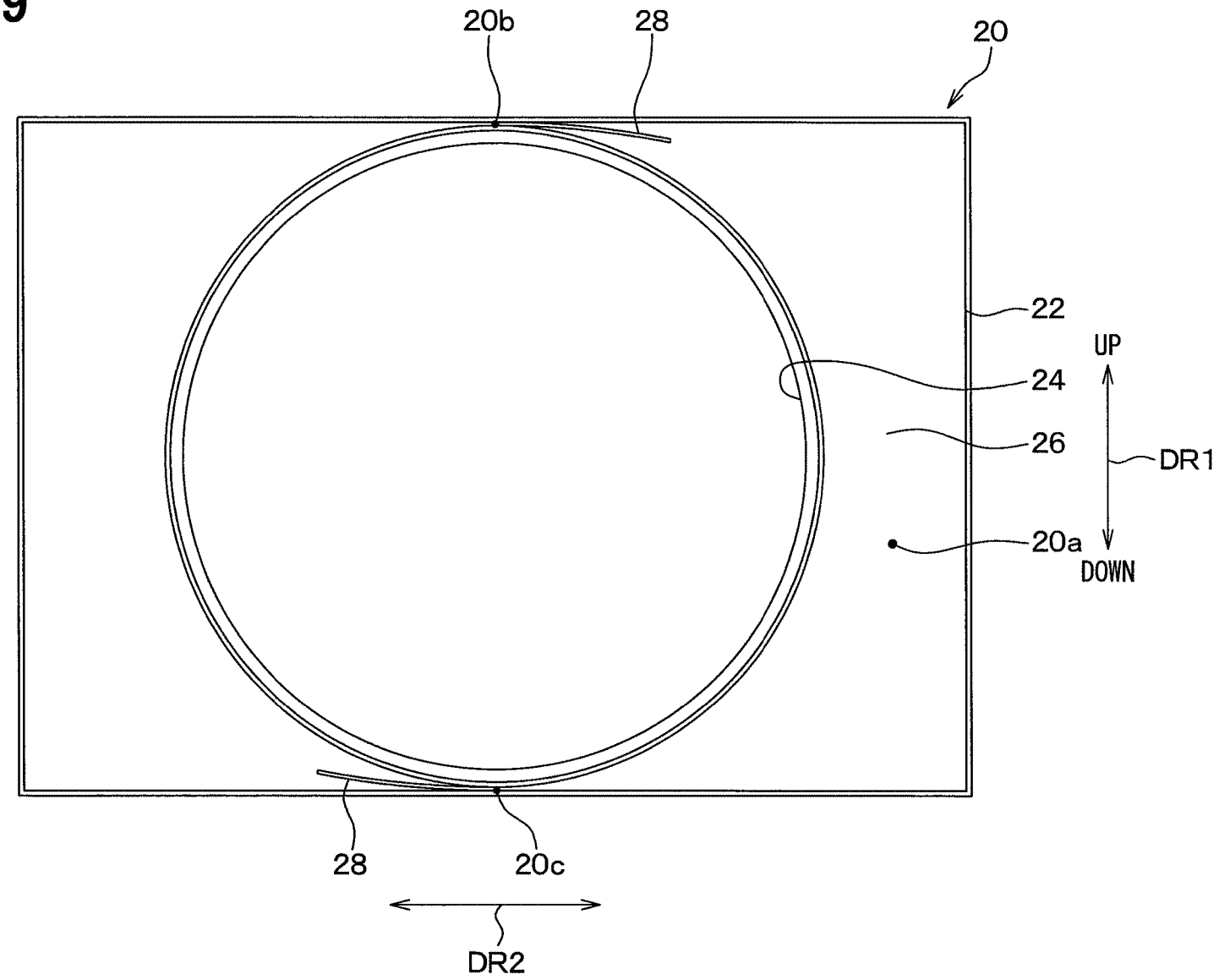
FIG. 19 is a schematic front view illustrating a fan shroud of the fifth embodiment.

A fifth embodiment is described with reference to FIG. 18 and FIG. 19. As shown in FIG. 18 and FIG. 19, a distance between the air outlet part 24 and the rib 28 in the radial direction of the axial fan 10 is increased as separating from the narrow portion 20*b*, 20*c*, in this embodiment. In other words, the distance between the rib 28 and the ring portion 18 in the circumference of the narrow portion 20*b*, 20*c* is larger than the distance between the rib 28 and the ring portion 18 at the narrow portion 20*b*, 20*c*.

Specifically, the rib 28 of this embodiment has a shape curved along the peripheral part of the air outlet part 24. The curvature of the rib 28 of this embodiment is smaller than that of the peripheral part of the air outlet part 24.

The other structure is the same as that of the first embodiment. The blowing device 1 of this embodiment can acquire the action and effect common as the blowing device 1 of the first embodiment.

The distance between the air outlet part 24 and the rib 28 of the blowing device 1 in the radial direction of the axial fan 10 is increased as separating from the narrow portion 20*b*, 20*c*, in this embodiment. For this reason, a disturbance, which becomes a generating factor of a new noise, can be restricted from being generated in the air flow at the boundary between a portion in which the rib 28 is formed and a portion in which the rib 28 is not formed, in the fan shroud 20 of the blowing device 1 of this embodiment.

Other Embodiment

The embodiments of the present disclosure are described, but the present disclosure can be changed variously as follows, for example, without being limited to the above-mentioned embodiments.

In the embodiments, the blowing device 1 of the present disclosure is applied to a device which sends air to the radiator 2, but is not limited to this. The blowing device 1 can be applied to a device which sends air to other heat exchanger other than the radiator 2. The blowing device 1 is able to be applied to a device which sends air to a heat exchanger in home or a factory, not only the heat exchanger in the vehicle.

In the embodiments, the blade 14 of the axial fan 10 is explained as a backswept wing, but is not limited to this. The blade 14 of the axial fan 10 may be, for example, a forward-swept wing or a straight wing.

In the embodiments, the peripheral ends of the blades 14 are connected by the ring portion 18 as the axial fan 10, but are not limited to this. The axial fan 10 may have a configuration, for example, that the peripheral ends of the blades 14 are not connected by the ring portion 18.

Although it is desirable, like each of the embodiments, that the rib 28 is formed in each of the narrow portions 20*b*, 20*c*, 20*d* of the fan shroud 20, but is not limited to this. The fan shroud 20 may have the rib 28, for example, in a part of the narrow portions 20*b*, 20*c*, 20*d*.

Although it is desirable that the shape of the rib 28 is curved along the peripheral part of the air outlet part 24, like each of the embodiments, but is not limited to this. For example, a part of the rib 28 may be shaped in straight extending in the tangential direction of the peripheral part of the air outlet part 24.

Although it is desirable to form the rib 28, like each of the embodiments, to extend from the narrow portion 20*b*, 20*c* to a location advanced in the rotational direction AR than the narrow portion 20*b*, 20*c*, but is not limited to this. The blowing device 1 may have the rib 28 formed to extend from the narrow portion 20*b*, 20*c* to, for example, a location retarded in the rotational direction AR than the narrow portion 20*b*, 20*c*.

The axial fan 10 of the blowing device 1 is arranged downstream of the radiator 2 in the air flow in each of the embodiments, but is not limited to this. The axial fan 10 may be arranged upstream of the radiator 2 in the air flow, if the blowing device 1 has the rib 28 projected toward the radiator 2, near the narrow portion 20*b*, 20*c*, 20*d* in the fan shroud 20. In this case, it is desirable to make the air outlet part 24 to have a shape corresponding to the peripheral form of the radiator 2 so that the air flow from the axial fan 10 is easily introduced into the radiator 2.

In the respective embodiments above, it goes without saying that elements forming the embodiments are not necessarily essential unless specified as being essential or deemed as being apparently essential in principle.

In a case where a reference is made to the components of the respective embodiments as to numerical values, such as the number, values, amounts, and ranges, the components are not limited to the numerical values unless specified as being essential or deemed as being apparently essential in principle.

In a case where a reference is made to the components of the respective embodiments above as to shapes and positional relations, the components are not limited to the shapes and the positional relations unless explicitly specified or limited to particular shapes and positional relations in principle.

Conclusion

According to the first viewpoint represented by a part or all of the embodiments, the blowing device includes the passage formation part, and the passage formation part has a rib projected toward the heat exchanger. The rib is defined within a range corresponding to a narrow portion where the air inlet part and a peripheral part of the axial fan are close to each other in a radial direction of the axial fan.

According to the second viewpoint, in the blowing device, the rib has a shape curved along a peripheral part of the air outlet part. Therefore, the distance between the rib and the peripheral part of the axial fan in the circumference of the narrow portion can be approximately the same as the distance between the rib and the peripheral part of the axial fan at the narrow portion. For this reason, the pressure fluctuation near the peripheral side of the axial fan at the narrow portion can be fully restricted from becoming extremely large, compared with its circumference location.

According to the 3rd viewpoint, in the blowing device, the rib is defined to extend from at least the narrow portion and to advance in a rotational direction of the axial fan than the narrow portion.

According to the inventors' knowledge, the pressure fluctuation on the peripheral side of the axial fan easily becomes large at the position advanced in the rotational direction of the axial fan from the narrow portion of the fan shroud than at the position behind the narrow portion in the rotational direction of the axial fan.

For this reason, the pressure fluctuation near the peripheral side of the axial fan can be effectively suppressed by forming the rib over the area at least from the narrow portion to the position advanced in the rotational direction of the axial fan than the narrow portion.

According to the 4th viewpoint, in the blowing device, a height of the rib in an axial direction of the axial fan is reduced at least in a part, as separating from the narrow portion. Therefore, a disturbance which becomes a generating factor of a new noise can be restricted from being generated in the air flow at the boundary between the portion in which the rib is formed and the portion in which the rib is not formed.

According to the 5th viewpoint, in the blowing device, a distance between the rib and a peripheral part of the air outlet part in the radial direction of the axial fan is increased as separating from the narrow portion. Therefore, a disturbance which becomes a generating factor of a new noise can be restricted from being generated in the air flow at the boundary between the portion in which the rib is formed and the portion in which the rib is not formed.

According to the 6th viewpoint, in the blowing device, the rib is located in a part including the narrow portion, and no rib is defined in a portion where the air inlet part and the peripheral part of the axial fan are most distant from each other in the radial direction of the axial fan.

Thus, non-intentional pressure fluctuation can be restricted from being generated in a location distant from the narrow portion, since the rib is provided in the part including the narrow portion of the fan shroud.

According to the 7th viewpoint, in the blowing device, the rib is defined to extend from a portion behind the narrow portion in the rotational direction of the axial fan to a portion advanced in the rotational direction of the axial fan than the narrow portion. Therefore, it becomes possible to control the rotation noise, i.e., BPF noise, without worsening the loading nature to the vehicle.

According to the 8th viewpoint, in the blowing device, the passage formation part has a first rib and a second rib projected toward the heat exchanger, within a range extended from the narrow portion to a portion advanced in the rotational direction of the axial fan than the narrow portion. The second rib is located to space from the first rib in a circumferential direction, and is located at a position advanced in the rotational direction of the axial fan than the first rib. Since the plural ribs are projected from the fan shroud, disturbance can fully be suppressed in the air flow near the narrow portion.

According to the 9th viewpoint, in the blowing device, the axial fan is arranged downstream of the heat exchanger in the air flow, and the air outlet part has a shape surrounding an outer side of the axial fan. Since the axial fan does not becomes ventilation resistance for the air flow which flows into the heat exchanger, the flow rate of air which passes through the heat exchanger is fully securable.

What is claimed is:

1. A blowing device that sends air, the blowing device comprising:

an axial fan configured to generate an air flow to pass a heat exchanger; and a fan shroud housing the axial fan, the air flow generated by the axial fan passing through the fan shroud, wherein the fan shroud includes an air inlet part into which the air flow is introduced to pass the heat exchanger, the air inlet part having a shape corresponding to a peripheral shape of the heat exchanger, an air outlet part from which the air flow introduced into the air inlet part flows out, and a passage formation part that connects the air inlet part and the air outlet part with each other to define an air passage through which air introduced from the air inlet part flows to the air outlet part, the passage formation part has at least one rib projected toward the heat exchanger, the rib is defined within a range corresponding to a narrow portion where the air inlet part and a peripheral part of the axial fan are close to each other in a radial direction of the axial fan, and a distance between the rib and a peripheral part of the air outlet part in the radial direction of the axial fan is increased in a rotational direction away from the narrow portion.

2. The blowing device according to claim 1, wherein the rib has a shape curved along a peripheral part of the air outlet part.

3. The blowing device according to claim 1, wherein the rib is defined to extend from at least the narrow portion and to advance in the rotational direction of the axial fan.

4. The blowing device according to claim 1, wherein a height of the rib in an axial direction of the axial fan is reduced at least in a part, in the rotational direction away from the narrow portion.

5. The blowing device according to claim 1, wherein the rib is located in a part including the narrow portion, and no rib is defined in a portion where the air inlet part and the peripheral part of the axial fan are most distant from each other in the radial direction of the axial fan.

6. The blowing device according to claim 1, wherein the rib is defined to extend from a portion behind the narrow portion in the rotational direction of the axial fan to a portion advanced in the rotational direction of the axial fan.

7. The blowing device according to claim 1, wherein the passage formation part has a first rib and a second rib projected toward the heat exchanger, within a range extended from the narrow portion to a portion advanced in the rotational direction of the axial fan, and the second rib is located to space from the first rib in a circumferential direction, and is located at a position more advanced in the rotational direction of the axial fan than the first rib.

8. The blowing device according to claim 1, wherein the axial fan is arranged downstream of the heat exchanger in the air flow, and the air outlet part has a shape surrounding an outer side of the axial fan.

9. A blowing device that sends air, the blowing device comprising:

an axial fan configured to generate an air flow to pass a heat exchanger; and a fan shroud housing the axial fan, the air flow generated by the axial fan passing through the fan shroud, wherein the fan shroud includes an air inlet part into which the air flow is introduced to pass the heat exchanger, the air inlet part having a shape corresponding to a peripheral shape of the heat exchanger, an air outlet part from which the air flow introduced into the air inlet part flows out, and a passage formation part that connects the air inlet part and the air outlet part with each other to define an air passage through which air introduced from the air inlet part flows to the air outlet part, the passage formation part has at least one rib projected toward the heat exchanger, the rib is defined within a range corresponding to a narrow portion where the air inlet part and a peripheral part of the axial fan are close to each other in a radial direction of the axial fan, the rib is located in a part including the narrow portion, no rib is defined in a portion where the air inlet part and the peripheral part of the axial fan are most distant from each other in the radial direction of the axial fan, the rib is defined to extend from a portion behind the narrow portion in a rotational direction of the axial fan to a portion advanced in the rotational direction of the axial fan, and a height of the rib in an axial direction of the axial fan is reduced at least in a part, in the rotational direction away from the narrow portion.

10. The blowing device according to claim 9, wherein the rib has a shape curved along a peripheral part of the air outlet part.

11. The blowing device according to claim 9, wherein the rib is defined to extend from at least the narrow portion and to advance in the rotational direction of the axial fan.

12. The blowing device according to claim 9, wherein a distance between the rib and a peripheral part of the air outlet part in the radial direction of the axial fan is increased in the rotational direction away from the narrow portion.

13. The blowing device according to claim 9, wherein the axial fan is arranged downstream of the heat exchanger in the air flow, and the air outlet part has a shape surrounding an outer side of the axial fan.

* * * * *